US009786461B2

(12) United States Patent
Onoda et al.

(10) Patent No.: US 9,786,461 B2
(45) Date of Patent: Oct. 10, 2017

(54) COMPONENT UNIT, FUSIBLE LINK UNIT, AND AFFIXING STRUCTURE FOR THE COMPONENT

(71) Applicant: Yazaki Corporation, Tokyo (JP)

(72) Inventors: Shinya Onoda, Makinohara (JP); Takahiro Shiohama, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/995,379

(22) Filed: Jan. 14, 2016

(65) Prior Publication Data

US 2016/0203933 A1 Jul. 14, 2016

(30) Foreign Application Priority Data

Jan. 14, 2015 (JP) ..... 2015-005305

(51) Int. Cl.
*H01H 85/02* (2006.01)
*H01H 85/20* (2006.01)
*H01H 85/055* (2006.01)

(52) U.S. Cl.
CPC ..... *H01H 85/0241* (2013.01); *H01H 85/2045* (2013.01); *H01H 2085/025* (2013.01); *H01H 2085/0555* (2013.01)

(58) Field of Classification Search
CPC ..... H01H 85/0241; H01H 2085/0555; H01H 2085/025; H01H 85/2045; H01H 2085/0034; H01H 85/003; H01H 85/175; H01H 9/223; H01H 9/045; H01H 85/0017; H01H 2221/062
USPC ..... 337/186, 190, 201, 205, 234
See application file for complete search history.

(56) References Cited

U.S. PATENT DOCUMENTS 8,082,707 B1 * 12/2011 Lewis ..... B64C 1/1492 181/207
2009/0108982 A1 * 4/2009 Ohashi ..... H01H 85/044 337/191
2010/0019572 A1 * 1/2010 Kudo ..... H01H 85/044 307/10.7

(Continued)

FOREIGN PATENT DOCUMENTS

JP 2013-037949 A 2/2013
WO WO 2011083862 A1 * 7/2011 ..... B60R 16/0238

OTHER PUBLICATIONS

Shimizu, Masaru, Structure for Fixing Electrical Junction Box, Jul. 14, 201, Yazaki Corp, Entire Document (Translation of WO 2011083862).*

*Primary Examiner* — Anatoly Vortman
*Assistant Examiner* — Stephen Sul
(74) *Attorney, Agent, or Firm* — Locke Lord LLP

(57) ABSTRACT

Provided is a fusible link unit in which a case includes case-side locking portions to be locked in a fusible link so as to affix the fusible link, the fusible link includes fusible link-side locking portions locked in the case-side locking portions, the fusible link-side locking portion on one side in a longitudinal direction is provided closer to a connected position of a bus bar than the fusible link-side locking portion on the other side in the longitudinal direction, and a gap size between the fusible link-side locking portion on the one side and the case-side locking portion in a vertical direction is made greater than a gap size between the fusible link-side locking portion on the other side and the case-side locking portion in the vertical direction.

6 Claims, 6 Drawing Sheets

(56) References Cited

U.S. PATENT DOCUMENTS

2012/0309239 A1* 12/2012 Onoda ..... H01R 13/447
439/766
2015/0353325 A1* 12/2015 Vincent ..... B66B 11/04
187/254

* cited by examiner

COMPONENT UNIT, FUSIBLE LINK UNIT, AND AFFIXING STRUCTURE FOR THE COMPONENT

CROSS-REFERENCE TO RELATED APPLICATION

This application claims the benefit of Japanese Patent Application No. 2015-005305, the entire disclosure of which is incorporated by reference herein.

TECHNICAL FIELD

The present invention relates to a component unit in which a component is affixed to an object for affixing through a case installed in the object for affixing, a fusible link unit, and an affixing structure for the component.

BACKGROUND

Related Art

Various components are included in a vehicle such as a car, and a component unit which includes these components and is used to be affixed to an object for affixing in the vehicle has been variously proposed (for example, refer to JP 2013-37949 A).

In a conventional component unit illustrated in FIG. 6, a fuse unit 500 as an example of a component is connected to a battery post (not illustrated) provided in a battery which is an object for affixing, through a battery terminal 600. The fuse unit 500 includes a main body portion 501, a battery-side terminal 502, and a load-side terminal 503. On the inside of the main body portion 501, the battery-side terminal 502 and the load-side terminal 503 are connected to each other by a fuse element which fuses when an excess current flows. In addition, the battery-side terminal 502 includes a bolt hole 521 into which a bolt 601 of the battery terminal 600 is inserted. A bolt 531 inserted into a bolt hole 701 of a connection member 700 is vertically arranged on the load-side terminal 503, and the load-side terminal 503 is electrically connected to the connection member 700 when the bolt 531 is fastened to a nut (not illustrated).

Meanwhile, a component such as the fuse unit 500 illustrated in FIG. 6 may be affixed through a case installed in an object for affixing such as a battery in some cases. In this case, the case accommodating the component is formed according to a maximum size considering tolerances of the accommodated component and a connection member connected to the component. In this regard, a component smaller in size than an inside of the case may be accommodated, and the component may be accommodated by absorbing a tolerance. However, when a connection member such as a bus bar is connected to the component, the component may be unfastened inside the case and in an unstable position. If the component is affixed inside the case in the unstable position, there is a problem in that the component or the connection member may be damaged when a force is applied to the component due to vibration of a car or the like.

In this regard, the invention focuses on the above-mentioned problem, and an object of the invention is to provide a component unit capable of absorbing a tolerance and capable of affixing a component in a stable state, a fusible link unit, and an affixing structure.

SUMMARY

A first aspect of the present invention provides a component unit including: a component; a connection member; and a case accommodating the component, wherein the connection member has one end connected to an object for affixing and the other end coming into contact with and connected to a connected position on one surface of the component, both the one surface of the component and the other surface opposed to the one surface thereof are positioned between the object for affixing and the connection member, and the component is affixed to the object for affixing via the case installed in the object for affixing, wherein the case includes a pair of case-side locking portions being locked in the component so as to affix the component, wherein the component includes a pair of component-side locking portions to be locked in the pair of case-side locking portions, and one of the component-side locking portions is provided closer to the connected position than the other of the component-side locking portions, and wherein a gap size between the one of the component-side locking portions and one of the case-side locking portions locked in the one of the component-side locking portions in a vertical direction with respect to the one surface of the component is made greater than a gap size between the other of the component-side locking portions and the other of the case-side locking portions locked in the other of the component-side locking portions in the vertical direction.

A second aspect of the present invention provides the component unit according to the first aspect, wherein the component further includes a guide rib extending along the vertical direction on a surface facing the case-side locking portions, and wherein the case further includes a groove into which the guide rib is inserted.

A third aspect of the present invention provides the component unit according to the first or second aspect, wherein the component further includes a guide rib extending along the vertical direction on a surface facing the case-side locking portions, and wherein the case further includes a groove into which the guide rib is inserted.

A fourth aspect of the present invention provides a fusible link unit including: a fusible link; a bus bar; and a case accommodating the fusible link, wherein the bus bar has one end connected to an object for affixing and the other end coming into contact with and connected to a connected position on one surface of the fusible link, both the one surface of the fusible link and the other surface opposed to the one surface thereof are positioned between the object for affixing and the bus bar, and the fusible link is affixed to the object for affixing via the case installed in the object for affixing, wherein the case includes a pair of case-side locking portions locked in the fusible link to affix the fusible link, wherein the fusible link includes a pair of fusible link-side locking portions locked in the pair of case-side locking portions, and one of the fusible link-side locking portions is provided closer to the connected position than the other of the fusible link-side locking portions, and wherein a gap size between the one of the fusible link-side locking portions and one of the case-side locking portions locked in the one of the fusible link-side locking portions in a vertical direction with respect to the one surface of the fusible link is made greater than a gap size between the other of the fusible link-side locking portions and the other of the case-side locking portions locked in the other of the fusible link-side locking portions in the vertical direction.

A fifth aspect of the present invention provides an affixing structure in which both one surface of a component and the other surface opposed to the one surface thereof are positioned between an object for affixing and a connection member having one end connected to the object for affixing and the other end coming into contact with and connected to a connected position on one surface of the component, and the component is affixed to the object for affixing through a case installed in the object for affixing, wherein the case includes a pair of case-side locking portions locked in the component to affix the component, wherein the component includes a pair of component-side locking portions locked in the pair of case-side locking portions, and one of the component-side locking portions is provided closer to the connected position than the other of the component-side locking portions, and wherein a gap size between the one of the component-side locking portions and one of the case-side locking portions locked in the one of the component-side locking portions in a vertical direction with respect to the one surface of the component is made greater than a gap size between the other of the component-side locking portions and the other of the case-side locking portions locked in the other of the component-side locking portions in the vertical direction.

According to the first aspect of the invention, one of component-side locking portions is provided closer to a connected position than the other of the component-side locking portions, and a gap size between the one of the component-side locking portions and one of the case-side locking portions locked in the one of the component-side locking portions in a vertical direction with respect to one surface of a component is made greater than a gap size between the other of the component-side locking portions and the other of the case-side locking portions locked in the other of the component-side locking portions in the vertical direction. When the connection member is connected on the one surface of the component, and when the component smaller in size than an inner size of a case is accommodated in the case due to tolerances of the component and the connection member, one side of the component-side locking portions of the component is pulled in the vertical direction with respect to the one surface of the component, and the other side thereof is also pulled due to the one side. In this instance, when the component is pulled until the other side of the component-side locking portions is locked in the case-side locking portion, the one of the component-side locking portions is pulled until the one of the component-side locking portions is locked in the case-side locking portion such that the component rotates using the other side of the component as a fulcrum. In this way when the connection member is fully connected to the component, a pair of component-side locking portions is locked in a pair of case-side locking portions and is affixed inside the case in a stable state, and thus it is possible to absorb tolerances, and to provide a component unit capable of affixing the component in a stable state.

According to the second aspect of the invention, even when the component is pulled to a side of the connection member at the time of connecting the connection member to the component, since a hook portion is formed to extrude to a side of the component in a direction intersecting a vertical direction, the component may be more reliably locked in the component, thereby affixing the component inside the case in a stable state.

According to the third aspect of the invention, the component further includes a guide rib extending along the vertical direction on a surface facing the case-side locking portions, and the case further includes a groove into which the guide rib is inserted. Thus, when the component is connected to the connection member, the component may be affixed inside the case in a more stable state.

According to the fourth aspect of the invention, one of fusible link-side locking portions is provided closer to a connected position than the other of the fusible link-side locking portions, and a gap size between the one of the fusible link-side locking portions and one of the case-side locking portions locked in the one of the fusible link-side locking portions in a vertical direction with respect to one surface of a fusible link is made greater than a gap size between the other of the fusible link-side locking portions and the other of the case-side locking portions locked in the other of the fusible link-side locking portions in the vertical direction. When the fusible link smaller in size than an inner size of a case is accommodated in the case due to tolerances of the fusible link and a bus bar at the time of connecting the bus bar on one surface of the fusible link, one side of the fusible link-side locking portions of the fusible link is pulled in a vertical direction with respect to the one surface of the fusible link, and the other side thereof is pulled due to the one side. In this instance, when the fusible link is pulled until the other of the fusible link-side locking portions is locked in the case-side locking portion, the one of the fusible link-side locking portions is pulled until the one of the fusible link-side locking portions is locked in the case-side locking portion such that the fusible link rotates using the other side of the fusible link as a fulcrum. In this way when the bus bar is fully connected to the fusible link, a pair of case-side locking portions is locked in a pair of fusible link-side locking portions and is affixed inside the case in a stable state. Thus, it is possible to absorb the tolerances, and to provide a fusible link unit capable of affixing the fusible link in a stable state.

According to the fifth aspect of the invention, one of component-side locking portions is provided closer to a connected position than the other of the component-side locking portions, and a gap size between the one of the component-side locking portions and one of the case-side locking portions locked in the one of the component-side locking portions in a vertical direction with respect to one surface of a component is made greater than a gap size between the caller of the component-side locking portions and the other of the case-side locking portions locked in the other of the component-side locking portions in the vertical direction. When the component smaller in size than an inner size of a case is accommodated in the case due to tolerances of an object for affixing, the component, and the connection member at the time of connecting a connection member on the one surface of the component, one side of the component-side locking portions of the component is pulled in the vertical direction with respect to the one surface of the component, and the other side thereof is pulled due to the one side. In this instance, when the component is pulled until the other side of the component-side locking portions is locked in the case-side locking portion, the one of the component-side locking portions is pulled until the one is locked in the case-side locking portion such that the component rotates using the other side of the component as a fulcrum. In this way, when the connection member is fully connected to the component, a pair of component-side locking portions is locked in a pair of case-side locking portions and is affixed inside the case in stable state. Thus, it is possible to absorb the tolerances, and to provide an affixing structure capable of affixing the component in a stable state.

DETAILED DESCRIPTION

A description will be given of a "component unit", a "fusible link unit", and a "affixing structure for the fusible link unit (component)" according to an embodiment of the invention with reference to FIGS. 1 to 5. A nut fastened to a bus bar-side terminal 32 of a fusible link 30 described below is not illustrated in FIGS. 4 and 5.

Figure 1:
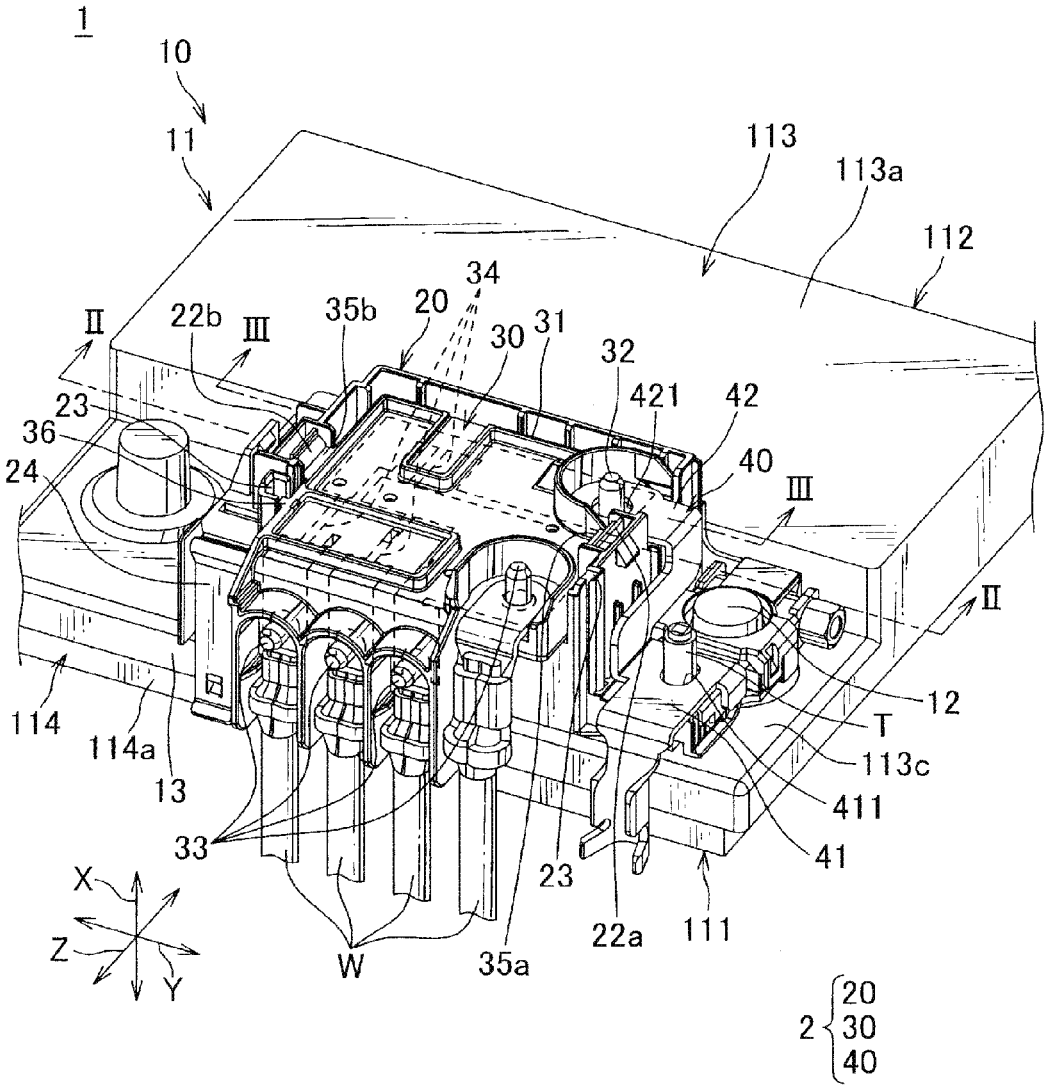
FIG. 1 is a perspective view of an affixing structure according to an embodiment of the invention.
Figure 2:
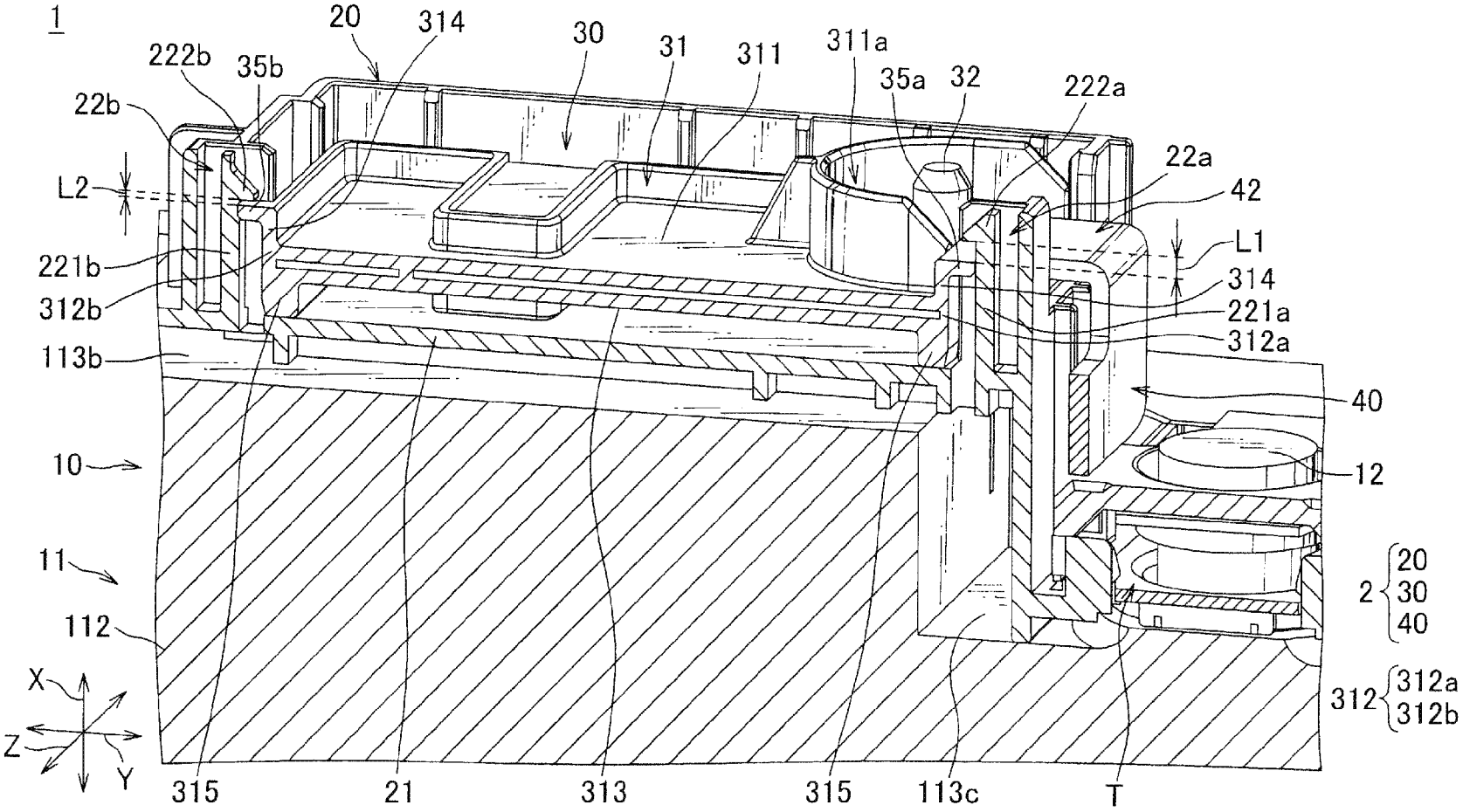
FIG. 2 is a diagram illustrating a cross section of the affixing structure illustrated in FIG. 1 taken along arrow line II-II.

As illustrated in FIG. 1, an affixing structure 1 of the present embodiment is a structure for affixing the fusible link 30 to a battery 10 through a case 20 installed in the battery 10 in a car. In addition, a bus bar 40 is connected to the fusible link 30. The bus bar 40 has one end 41 connected to the battery 10 and the other end 42 coming into contact with and connected to a connected position 311*a* on an upper surface 311 of the fusible link 30 (FIG. 2). In other words, the fusible link 30 is positioned between the battery 10 and the bus bar 40. In addition, a fusible link unit 2 of the present embodiment includes the fusible link 30, the bus bar 40, and the case 20. In the present embodiment, a vertical direction is set to an arrow X direction in the drawings, a longitudinal direction is net to an arrow Y direction in the drawings, and a width direction is set to an arrow Z direction in the drawings.

The bus bar 40 is formed by pressing a metal plate. In the bus bar 40, the one end 41 is connected to a battery terminal T which is connected to a battery post 12 of the battery 10 to be described below, and the other end 42 is connected to the bus bar-side terminal 32 of the fusible link 30 to be described below. In addition, the one end 41 and the other end 42 of the bus bar 40 are provided with terminal holes 411 and 421 for insertion of the battery terminal T and the bus bar-side terminal 32, and are electrically connected to the battery 10 and the fusible link 30 by being fastened using nuts (not illustrated).

The battery 10 includes a box-shaped cover body 11 formed using synthetic resin, and a main battery body (not illustrated) is accommodated in the cover body 11. In addition, the cover body 11 is provided with the battery post 12 extruding upward and a lock portion 13 locked in an arm 24 of the case 20 to be described below.

The cover body 11 includes a lower cover 111 that accommodates the main battery body (not illustrated) and an upper cover 112 that covers an upper portion of the lower cover 111. The upper cover 112 includes an upper surface portion 113 and a side surface portion 114 extended from the upper surface portion 113 to hang down around a circumference. In addition, the upper surface portion 113 is formed in a stepped shape including a first upper surface portion 113*a*, a second upper surface portion 113*b* (FIG. 2 on which the case 20 is installed, and a third upper surface portion 113*c* positioned below the second upper surface portion 113*b* and provided with the battery post 12. The lock portion 13 is provided on one side surface portion 114*a* (a surface on a closer to side in the width direction Z of FIG. 1) of the upper cover 112.

The case 20 is formed using synthetic resin. As illustrated in FIG. 2, the case 20 includes a bottom wall 21 facing the second upper surface portion 113*b* of the battery 10, a pair of case-side locking portions 22*a* and 22*b* locked in the fusible link 30 to affix the fusible link 30, a groove 23 into which a guide rib 36 of the fusible link 30 described below is inserted, and the arm 24 locked in the lock portion 13 of the battery 10.

The pair of case-side locking portions 22*a* and 22*b* is provided at both sides in the longitudinal direction Y. That is, the case-side locking portion 22*a* is provided on one side in the longitudinal direction Y, and the case-side locking portion 22*b* is provided on the other side in the longitudinal direction Y. In addition, the respective case-side locking portions 22*a* and 22*b* include vertically arranged portions 221*a* and 221*b* vertically arranged upward from the bottom wall 21, and hook portions 222*a* and 222*b* provided at distal ends of the vertically arranged portions 221*a* and 221*b* and locked in fusible link-side locking portions 35*a* and 35*b* of the fusible link 30 described below. The hook portions 222*a* and 222*b* are formed to protrude toward a side of the fusible link 30 in the longitudinal direction Y. In addition, the hook portion 222*a* of the case-side locking portion 22*a* provided on one side in the longitudinal direction Y is positioned above the hook portion 222*b* of the case-side locking portion 22*b* provided on the other side in the longitudinal direction Y. The groove 23 is provided closer to each of the case-side locking portions 22*a* and 22*b* (on a closer to side in a page space of FIG. 1) at both sides in the longitudinal direction Y. A direction in which the hook portions 222*a* and 222*b* extrude preferably corresponds to a direction intersecting the vertical direction X (a vertical direction with respect to the upper surface 311 of the fusible link 30) toward the side of the fusible link 30, and may correspond to a direction shifted from the longitudinal direction Y toward the side of the fusible link 30.

The fusible link 30 includes a housing 31 substantially formed in a shape of a rectangular parallelepiped, the bus bar-side terminal 32 connected to the other end 42 of the bus bar 40, a plurality of load-side terminals 33, a plurality of fuse elements 34 that connects the bus bar-side terminal 32 to the load-side terminals 33, a pair of fusible link-side locking portions 35*a* and 35*b* locked in the case-side locking portions 22*a* and 22*b* of the case 20, and the guide rib 36 inserted into the groove 23 of the case 20.

The housing 31 includes the upper surface 311, a side surface 312 extended from the upper surface 311 to hang down around a circumference, and a lower surface 313 facing the upper surface 311. Side surfaces 312*a* and 312*b* of the side surface 312 facing each other in the longitudinal direction Y are provided with an upper extended portion 314 extended upward from upper ends of the side surfaces 312*a* and 312*b* and a lower extended portion 315 extended downward from lower ends thereof. In addition, as illustrated in FIG. 2, a portion of the upper extended portion 314, in which the bus bar 40 is arranged, on one side in the longitudinal direction Y is notched.

The bus bar-side terminal 32 is provided in the connected position 311*a* on the upper surface 311 of the housing 31. The connected position 311*a* is positioned on one side in the longitudinal direction Y. In other words, the bus bar 40 comes into contact with and is connected to a surface facing the second upper surface portion 113*b* of the battery 10 in which the case 20 is installed in the fusible link 30.

Each of the plurality of load-side terminals 33 is connected to a load through a wire W. The fuse elements 34 are configured to prevent an excess current or an increase in temperature at the time of conducting by fusing when the excess current flows.

The fusible link-side locking portions 35*a* and 35*b* are extended from an upper end of the upper extended portion 314 and formed to extrude outward from the housing 31 (to an outer side in the longitudinal direction Y), and the fusible link-side locking portion 35*a* is provided closer to the connected position 311*a* than the fusible link-side locking portion 35*b*. In addition, the fusible link-side locking portion 35*a* is provided on one side in the longitudinal direction Y and locked in the case-side locking portion 22*a*, and the fusible link-side locking portion 35*b* is provided on the other side in the longitudinal direction Y and locked in the case-side locking portion 22*b*.

FIG. 2 illustrates a state in which the fusible link 30 is accommodated in the case 20 and is not connected to the bus bar 40. In the state illustrated in FIG. 2, maize L1 of a gap in the vertical direction X (a direction orthogonal to the upper surface 311 of the fusible link 30) between the fusible link-side locking portion 35*a* on one side in the longitudinal direction Y and the hook portion 222*a* of the case-side locking portion 22*a* is made greater than a size L2 of a gap in the vertical direction X between the fusible link-side locking portion 35*b* on the other side in the longitudinal direction Y and the hook portion 222*b* of the case-side locking portion 22*b*. In the present embodiment, the "gap" refers to a so-called "allowance" provided to absorb tolerances of the battery 10, the case 20, the fusible link 30, and the bus bar 40. In the present embodiment, the gap having the size L2 is provided between the fusible link-side locking portion 35*b* on the other side in the longitudinal direction Y and the hook portion 222*b* of the case-side locking portion 22*b*. However, the gap may not be provided (that is, L2=0). The sizes L1 and L2 vary depending on the tolerances of the battery 10, the case 20, the fusible link 30, and the bus bar 40.

The guide rib 36 is provided to extrude outward from the housing 31 (to an outer side in the longitudinal direction Y) from an upper end to a lower end of the housing 31 at both sides in the longitudinal direction Y. In other words, the guide rib 36 is provided on a surface facing the case-side locking portions 22*a* and 22*b* of the fusible link 30.

Next, a description will be given of a method of affixing the fusible link 30 to the battery 10 with reference to FIGS. 1 to 5. The method below is an example, and a procedure may be appropriately changed.

First, the case 20 is placed on the second upper surface portion 113*b* of the battery 10, and the arm 24 of the case 20 is locked in the lock portion 13 of the battery 10 to install the battery 10 in the case 20. Subsequently as illustrated in FIGS. 1 to 3, the guide rib 36 is inserted into the groove 23 to accommodate the fusible link 30 in the case 20, and the bus bar 40 is connected to the bus bar-side terminal 32 of the fusible link 30 by fastening a nut.

Figure 3:
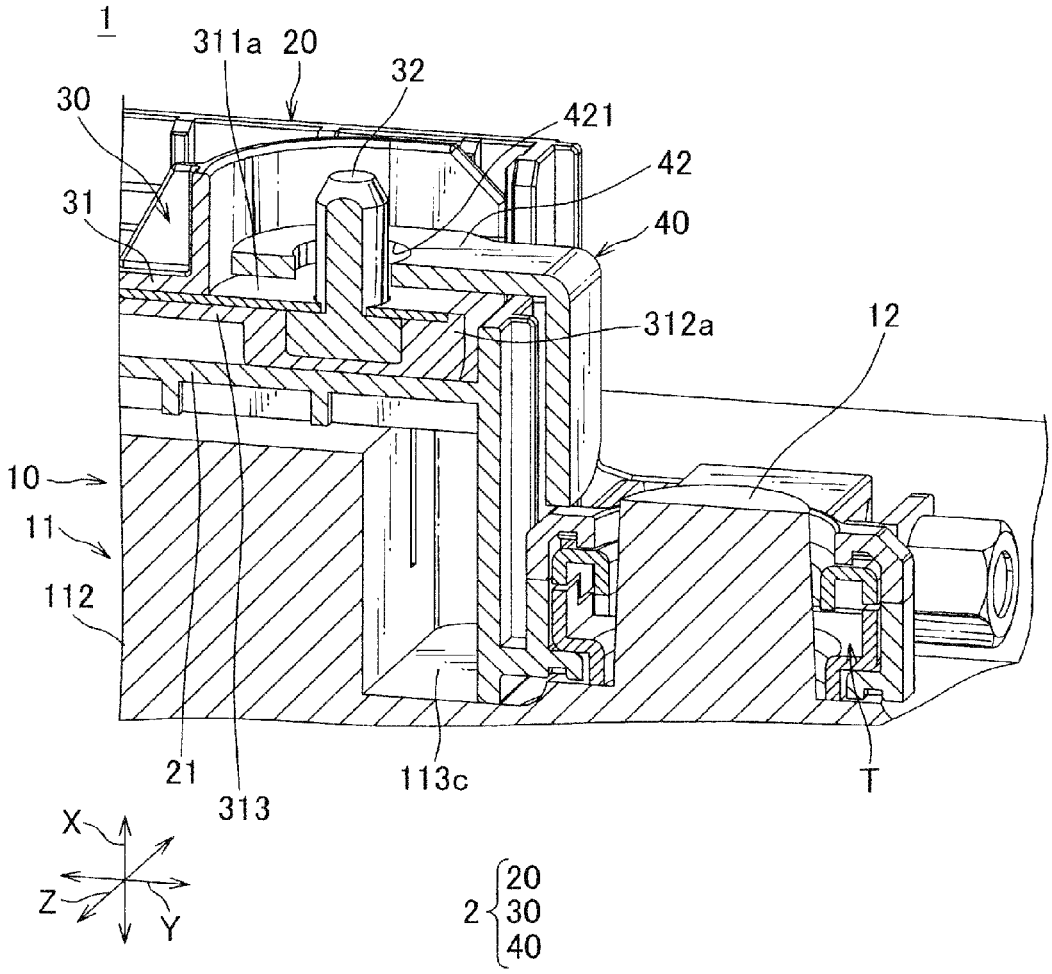
FIG. 3 is a diagram illustrating a main part in a cross section of the affixing structure illustrated in FIG. 1 taken along arrow line III-III.

FIGS. 2 and 3 illustrate a state in which the fusible link 30 is accommodated in the case 20 and the bus bar 40 is not connected to the fusible link 30. In this instance, the lower extended portion 315 of the fusible link 30 comes into contact with the bottom wall 21 of the case 20 at both sides in the longitudinal direction Y. When the fusible link 30 smaller in size than an inner size of the case 20 is accommodated in the case 20 due to the tolerances of the battery 10, the case 20, the fusible link 30, and the bus bar 40, one side in the longitudinal direction Y of the fusible link. 30 is pulled upward due to fastening of a nut (not illustrated), and the other side thereof is pulled due to the one side. In this instance, when the fusible link 30 is pulled until the fusible link-side locking portion 35*b* provided on the other side in the longitudinal direction Y is locked in the case-side locking portion 22*b*, the fusible link-side locking portion 35*a* on the one side in the longitudinal direction Y is locked in the case-side locking portion 22*a* such that the fusible link 30 rotates using the other side of the fusible link 30 as a fulcrum, and the bus bar 40 is pulled until the bus bar 40 comes into contact with and is connected to the connected position 311*a*.

Figure 4:
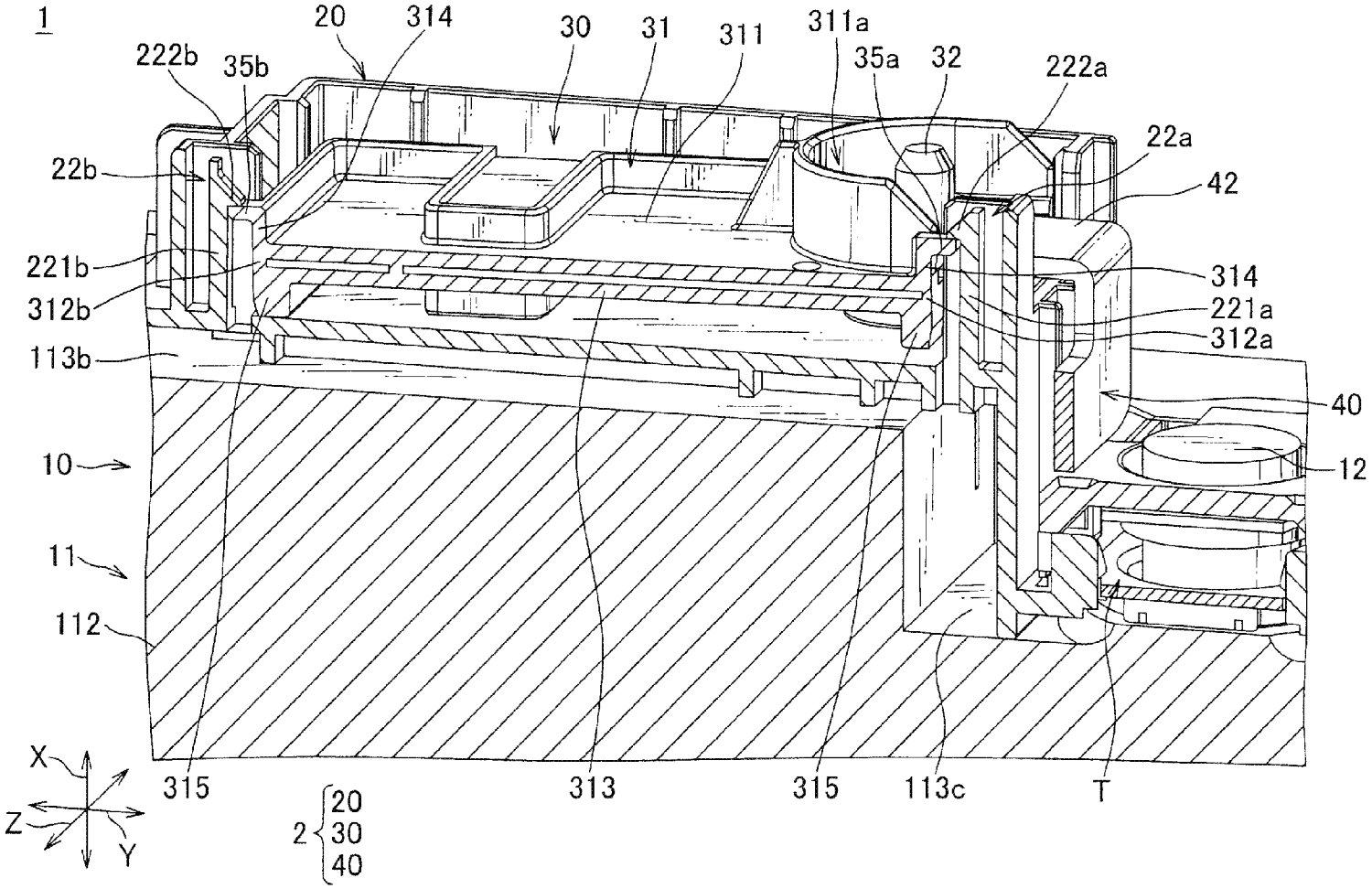
FIG. 4 is a diagram illustrating the affixing structure illustrated in FIG. 2 in a state in which a fusible link is electrically connected to a bus bar while omitting a nut.
Figure 5:
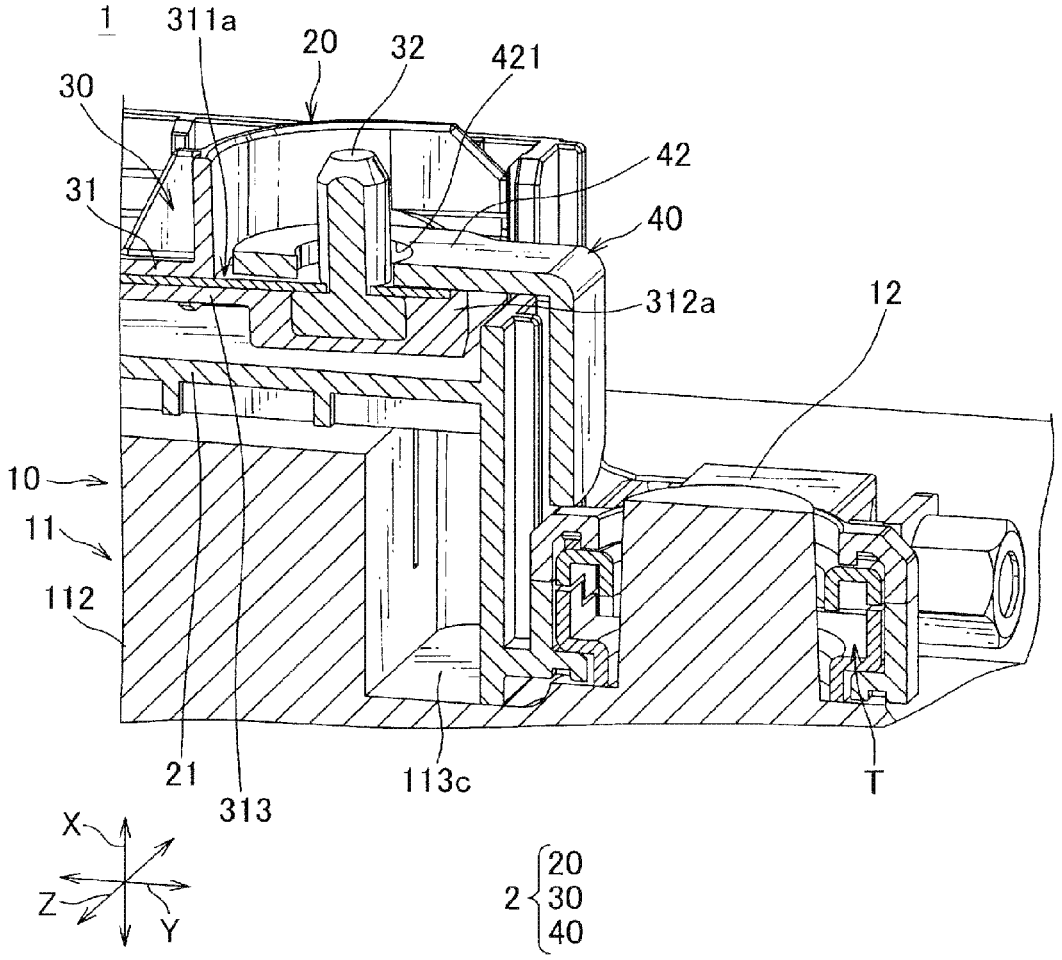
FIG. 5 is a diagram illustrating the affixing structure illustrated in FIG. 3 in a state in which the fusible link is electrically connected to the bus bar while omitting the nut.
Figure 6:
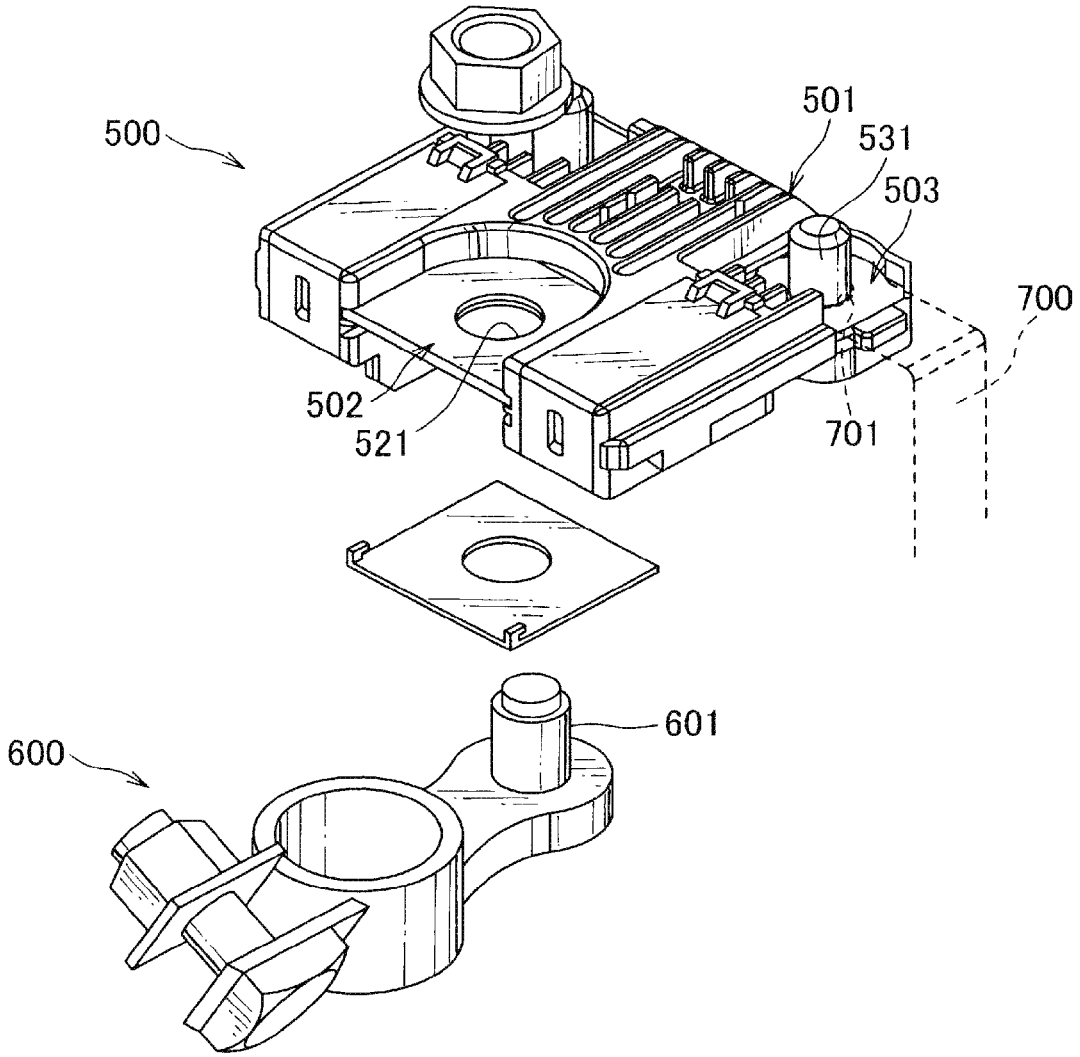
FIG. 6 PRIOR ART
FIG. 6 is a diagram illustrating an affixing structure of the related art.

FIGS. 4 and 5 illustrate a state in which the fusible link 30 is accommodated in the case 20 and the bus bar 40 is connected to the fusible link 30. In this instance, the fusible link-side locking portions 35*a* and 35*b* are locked in the case-side locking portions 22*a* and 22*b*, and the lower extended portion 315 of the fusible link 30 is separated from the bottom wall 21 of the case 20 at one side in the longitudinal direction Y and comes into contact with the bottom wall 21 at the other side in the longitudinal direction Y. In this way, movement of the fusible link 30 in the vertical direction X is restricted. In addition, when the guide rib 36 is inserted into the groove 23, movement of the fusible link 30 in the width direction Z is restricted. In this way the fusible link 30 is fully affixed to the battery 10 via the case 20.

According to the affixing structure 1 and the fusible link unit 2 of the present embodiment, the fusible link-side locking portion 35*a* on one side in the longitudinal direction Y is provided closer to the connected position 311*a* of the bus bar 40 than the fusible link-side locking portion 35*b* on the other side in the longitudinal direction Y, and the size L1 of the gap in the vertical direction X between the fusible link-side locking portion 35*a* and the case-side locking portion 22*a* is made greater than the size L2 of the gap in the vertical direction X between the fusible link-side locking portion 35*b* and the case-side locking portion 22*b*. In this way when the bus bar 40 is fully connected to the fusible link 30, the fusible link-side locking portions 35*a* and 35*b* are locked in the case-side locking portions 22*a* and 22*b* and affixed inside the case 20 in a stable state. Thus, it is possible to absorb the tolerances, and to affix the fusible link 30 in a stable state.

In addition, the fusible link 30 may be pulled to a side of the bus bar 40 when the bus bar 40 is connected to the fusible link 30. However, since the hook portions 222*a* and 222*b* are formed to extrude toward a side of the fusible link 30 in the longitudinal direction Y, the fusible link 30 may be more reliably locked in the hook portions 222*a* and 222*b*, thereby affixing the fusible link 30 inside the case 20 in a stable state.

Moreover, the fusible link 30 further includes the guide rib 36 that extends along the vertical direction X on the side surfaces 312*a* and 312*b* facing the case-side locking portion 22*a* and 22*b*, and the case 20 further includes the groove 23 into which the guide rib 36 is inserted. Thus, when the fusible link 30 is connected to the bus bar 40, movement in the width direction Z in addition to the vertical direction X is restricted, and thus the fusible link 30 may be affixed inside the case 20 in a more stable state.

The invention is not limited to the above-described embodiment, and the invention includes another configuration capable of achieving an object of the invention and a modification as below.

In the above-described embodiment, the invention is applied to a structure in which the fusible link 30 is affixed to the battery 10. However, the "component" in the invention is not restricted the fusible link, and the invention may be applied to a component affixed to an object for affixing through a case. For example, the invention may be applied to another electrical component such as a fuse or a relay, and a component having an electrical function. In addition, the "object for affixing" in the invention is not restricted to the battery, and the invention may be applied to an arbitrary vehicle body frame or the like. Further, the bus bar 40 serving as the connection member is connected to the fusible link 30. However, the "connection member" of the invention may not be an electrically connected member.

Furthermore, in the above-described embodiment, the bus bar 40 is connected to the upper surface 311 of the fusible link 30. However, connection may be performed such that the fusible link 30 is positioned between the battery 10 and the bus bar 40, and a connected surface is not restricted to the upper surface 311.

In addition, in the above-described embodiment, the case-side locking portions 22*a* and 22*b* are formed to have the hook portions 222*a* and 222*b*. However, the fusible link-side locking portions 35*a* and 35*b* may be locked in the case-side locking portions 22*a* and 22*b*, and shapes of the locking portions are not restricted to the above-described embodiment. For example, the hook portions may be formed in the fusible link-side locking portions (component-side locking portions).

Further, even though the best configuration, method, and the like for implementing the invention are disclosed in the above description, the invention is not limited thereto. In other words, for the most part, the invention is particularly illustrated and described with regard to a specific embodiment. However, those skilled in the art may variously change a shape, a material, quantity and other detailed configurations in the above-described embodiment without departing from the range of a technical sprit and an object of the invention.

Therefore, the above description restricting a shape, a material, and the like is illustratively given to facilitate understanding of the invention, and does not restrict the invention. Thus, the invention includes description using a name of a member except for some or all restrictions on the shape, the material, and the like.

What is claimed is:

1. A fusible link unit comprising:

a fusible link;

a bus bar; and a case accommodating the fusible link, wherein the bus bar has one end connected to a battery and the other end coming into contact with and connected to a connected position on one surface of the fusible link, both the one surface of the fusible link and a lower surface opposed to the one surface thereof are positioned between the battery and the bus bar, and the fusible link is affixed to the battery via the case installed in the battery, wherein the case includes a pair of case-side locking portions being locked in the fusible link so as to affix the fusible link, wherein the fusible link includes a pair of fusible link-side locking portions to be locked in the pair of case-side locking portions, and one of the fusible link-side locking portions is provided closer to the connected position than the other of the fusible link-side locking portions, and wherein a gap size between the one of the fusible link-side locking portions and one of the case-side locking portions locked in the one of the fusible link-side locking portions in a vertical direction with respect to the one surface of the fusible link is made greater than a gap size between the other of the fusible link-side locking portions and the other of the case-side locking portions locked in the other of the fusible link-side locking portions in the vertical direction.

2. The fusible link according to claim 1, wherein the case-side locking portions include vertically arranged portions vertically arranged in the vertical direction and hook portions provided at distal ends of the vertically arranged portions, and wherein the hook portions are formed to protrude toward a side of the fusible link in a direction intersecting the vertical direction.

3. The fusible link unit according to claim 2, wherein the fusible link further includes a guide rib extending along the vertical direction on a surface facing the case-side locking portions, and wherein the case further includes a groove into which the guide rib is inserted.

4. The fusible link unit according to claim 1, wherein the fusible link further includes a guide rib extending along the vertical direction on a surface facing the case-side locking portions, and wherein the case further includes a groove into which the guide rib is inserted.

5. A fusible link unit comprising:

a fusible link;

a bus bar; and a case accommodating the fusible link, wherein the bus bar has one end connected to a battery and the other end coming into contact with and connected to a connected position on one surface of the fusible link, both the one surface of the fusible link and a lower surface opposed to the one surface thereof are positioned between the object for affixing and the bus bar, and the fusible link is affixed to the battery via the case installed in the object for affixing, wherein the case includes a pair of case-side locking portions locked in the fusible link to affix the fusible link, wherein the fusible link includes a pair of fusible link-side locking portions locked in the pair of case-side locking portions, and one of the fusible link-side locking portions is provided closer to the connected position than the other of the fusible link side locking portions, and wherein a gap size between the one of the fusible link-side locking portions and one of the case-side locking portions locked in the one of the fusible link-side locking portions in a vertical direction with respect to the one surface of the fusible link is made greater than a gap size between the other of the fusible link-side locking portions and the other of the case-side locking portions locked in the other of the fusible link-side locking portions in the vertical direction.

6. An affixing structure in which both one surface of a fusible link and a lower surface opposed to the one surface thereof are positioned between a battery and a bus bar having one end connected to the battery and the other end coming into contact with and connected to a connected position on one surface of the fusible link, and the fusible link is affixed to the battery through a case installed in the object for affixing, wherein the case includes a pair of case-side locking portions locked in the fusible link to affix the fusible link, wherein the fusible link includes a pair of fusible link-side locking portions locked in the pair of case-side locking portions, and one of the fusible link-side locking portions is provided closer to the connected position than the other of the fusible link-side locking portions, and wherein a gap size between the one of the fusible link-side locking portions and one of the case-side locking portions locked in the one of the fusible link-side locking portions in a vertical direction with respect to the one surface of the fusible link is made greater than a gap size between the other of the fusible link-side locking portions and the other of the case-side locking portions locked in the other of the fusible link-side locking portions in the vertical direction.

* * * * *